US007858555B2

(12) United States Patent
Netsch

(10) Patent No.: US 7,858,555 B2
(45) **Date of Patent: *Dec. 28, 2010**

(54) LATENT IMAGE SYSTEMS, DEVELOPERS, AND BLOCKERS THEREFOR

(76) Inventor: Bryan A. Netsch, 444 Remington Pt., Highland Village, TX (US) 75077

( * ) Notice: Subject to any disclaimer, the term of this patent is extended or adjusted under 35 U.S.C. 154(b) by 1335 days.

This patent is subject to a terminal disclaimer.

(21) Appl. No.: 11/367,162

(22) Filed: Mar. 3, 2006

(65) Prior Publication Data

US 2007/0207416 A1 Sep. 6, 2007

(51) Int. Cl.
*B41M 5/128* (2006.01)

(52) U.S. Cl. ..... 503/201; 503/205; 503/216

(58) Field of Classification Search ..... None
See application file for complete search history.

(56) References Cited

U.S. PATENT DOCUMENTS

| | | | | |
|---|---|---|---|---|
| 3,809,560 | A | 5/1974 | Neuman | |
| 3,900,215 | A | 8/1975 | Kato et al. | |
| 4,012,538 | A * | 3/1977 | Miyamoto et al. | 503/201 |
| 4,439,512 | A | 3/1984 | Ceintrey | |
| 4,557,618 | A | 12/1985 | Iwata et al. | |
| 4,623,392 | A | 11/1986 | Ou-Yang | |
| 4,640,714 | A * | 2/1987 | Kagota et al. | 106/31.16 |
| 5,075,278 | A | 12/1991 | Vassiliades | |
| 5,236,885 | A * | 8/1993 | Tanimoto | 503/201 |
| 5,415,434 | A | 5/1995 | Kawashima | |
| 5,485,792 | A | 1/1996 | Keyser et al. | |
| 5,492,558 | A | 2/1996 | Miller et al. | |
| 5,503,665 | A | 4/1996 | Miller et al. | |
| 6,293,667 | B1 | 9/2001 | Gregory et al. | |
| 6,905,539 | B2 | 6/2005 | Patel et al. | |

FOREIGN PATENT DOCUMENTS

| | | |
|---|---|---|
| CA | 2 149 946 | 11/1996 |
| EP | 0 017 889 A1 | 10/1980 |

* cited by examiner

*Primary Examiner*—Bruce H Hess
(74) *Attorney, Agent, or Firm*—Luedeka, Neely & Graham, P.C.

(57) ABSTRACT

A latent image developing system, methods for imaging and developing images, and systems and methods for blocking or erasing latent images. The latent image developing system includes a substrate containing a colorless image deposited thereon. A developer instrument is used to provide a visible image. The developer instrument includes a developer composition reactive with the colorless image. An image blocking instrument is provided for concealing at least a portion of the visible image. The image blocking instrument is provided by a blocking composition applicator and an aqueous mixture of blocking composition and water.

14 Claims, 6 Drawing Sheets

LATENT IMAGE SYSTEMS, DEVELOPERS, AND BLOCKERS THEREFOR

FIELD

The disclosure relates to multicolor novelty printed products, image developer systems for the products and to methods for developing and blocking or concealing images to provide clandestine messages and other unique effects.

BACKGROUND AND SUMMARY

Substrates containing latent images have been used in the business forms market for producing security documents. The components used to develop images for the business forms are often self-contained in the forms typically by using microcapsules which are rupturable upon impact or contact with a suitable solvent. One such self-contained coating is described in U.S. Pat. No. 5,250,492 to Dotson et al. which relates to carbonless coating compositions for use with business forms or mailers. The business forms described by Dotson et al. are made using an admixture of a color former, a color developer, and a plurality of pressure-rupturable microcapsules containing solvent. A latent image printed with the admixture becomes visible upon application of pressure or solvent to the coated area to rupture or dissolve the microcapsules so that the solvent in the microcapsules interacts with the color developers and color formers in the coating.

While the methods and compositions of Dotson et al. are particularly suitable for business forms, they are not particularly suitable for preparing games and novelty products which contain hidden or latent multicolor images. Inadvertent rupture of the microcapsules containing solvent may result in image development particularly in unintended areas of the form while handling or shipping the form. Furthermore, it is difficult and expensive to prepare multi-color latent images using microcapsule technology to provide a color density required to maximize the color intensity for use in novelty products. For example, it is generally cost prohibitive to use microcapsule technology to produce low cost children's books, games, puzzles, activity sets, and the like in high volume with a color intensity that would be suitable for such children's items. Such products made by conventional techniques typically require heavy ink coverage to obtain suitable color intensities. Accordingly, improvements in hidden image technology are required to achieve the desired level of reliability and image sharpness and intensity and to reduce the expense and production difficulty of multi-color latent image products for the novelty and game markets.

With regard to the foregoing and other objects and advantages thereof, exemplary embodiments of the disclosure provide a latent image developing system, methods for imaging and developing images, and systems and methods for blocking or concealing latent images. The latent image developing system includes a substrate containing a colorless image deposited thereon. A developer instrument is used to provide a visible image. The developer instrument includes a developer composition reactive with the colorless image. An image blocking instrument is provided for concealing at least a portion of the visible image. The image blocking instrument is provided by a blocking composition applicator and an aqueous mixture of blocking composition and water.

Another embodiment of the disclosure provides a latent image blocking system. The latent image blocking system includes a substrate containing a developer composition deposited thereon. At least one marking instrument having a substantially colorless compound reactive with the developer composition is provided to produce a visible image on the substrate. An image blocking instrument for preventing development of at least a portion of the visible image is also included. The image blocking instrument includes a blocking composition applicator and an aqueous mixture of a blocking composition and water.

Other embodiments of the disclosure provide a method for selectively concealing a latent image developed on a substrate. The method includes providing a substrate containing a substantially colorless image deposited thereon. At least a portion of the colorless image is developed into a visible image by applying a developer composition with a developer instrument to the colorless image on the substrate to provide the visible image. An image concealing composition is applied to at least a portion of the visible image to conceal a portion of the visible image.

Still another embodiment of the disclosure provides a system for printing and developing a colorless image on a substrate. The system includes a substantially colorless flexographic ink base comprising a binder resin and from about 5 to about 20 percent by weight of a substantially colorless compound dissolved in a solvent portion of the ink base for printing the colorless image on the substrate. A developer instrument containing a developer compound dissolved in from about 65 to about 85 percent isopropyl alcohol is also provided.

An advantage of the systems, compositions, and methods described herein is that the images may be rapidly developed with high color intensity without having to apply relatively heavy ink coverage to a substrate to obtain the high color intensity images. The compositions and methods described herein are substantially more compatible with high speed printing techniques, such as four color processing, than conventional microcapsule latent image technology, and thus may provide optimum ink coverage with enhanced color intensity over conventional latent image printing technology. Accordingly, high volume, low cost activity sets, books, games, novelty items, and the like may be provided using the systems, methods and compositions described herein.

Another advantage of the compositions and methods described herein is that each of the components is substantially colorless until applied to a previously printed or coated substrate. Accordingly, the marking instruments and compositions may not stain or mark clothing, skin, furniture, walls or other objects.

Still another advantage of the embodiments described herein is the ability to provide clandestine messages by selective blocking development of latent images on a substrate.

BRIEF DESCRIPTION OF THE DRAWINGS

The above and other features of the disclosed embodiments may be further described in the following detailed specification in conjunction with the accompanying drawings in which.

DETAILED DESCRIPTION OF EXEMPLARY EMBODIMENTS

In the methods and systems described herein, components of the methods and systems may be deposited or printed on a substrate, preferably as a latent or substantially invisible image or as a substantially invisible developer component. By "substantially invisible" means that the deposited area may have a slight discoloration or may vary in tint from the adjacent substrate, however, to the casual observer, the variation in tint or coloration is so slight as to be essentially imperceptible prior to developing the image by the techniques described herein.

In a first embodiment of the disclosure illustrated in FIGS. 1-4, a substrate is provided with a latent image 12 printed thereon. The substrate 10 may be made from a wide variety of materials including, but not limited to, paper, wood, polyester, polystyrene, polypropylene, ceramic, metal, natural and synthetic cloth or fabric, and the like. A suitable plastic substrate 10 is polyester. Likewise, suitable paper substrates 10 include offset, matte or coated papers. A particularly useful paper substrate is offset paper available from Boise Cascade and MeadWestvaco paper companies and has a weight of about 50 to about 70 pounds per ream.

The latent image 12 may be printed on the substrate 10 by a wide variety of printing techniques including, but not limited to, flexographic, lithographic, sheet fed, web offset, rotogravure, gravure, screen printing, ink jet printing, and variable image printing techniques. Printing techniques which may be used to print the latent image 12 on the substrate 12 include spot printing and process printing. A particularly preferred printing technique is 3 or 4 color process printing. Process printing may be used with a web-offset or flexographic printer to deposit the latent image 12 on the substrate 10. When developed, 3 or 4 color process printed images may be more visually pleasing than spot printing the images because a wider variety of colors may be printed using process printed images. Also, process printed images enable use of lower weights of ink to be printed while providing higher intensity of printed images.

In the case of printing the latent image 12 with a variety of substantially colorless chromogenic ink formulations, a flexographic printing technique is particularly suitable and provides the latent image 12 having a image thickness ranging from about 0.25 micron to about 3 microns. Thicker or thinner layers of the image 12 may be used to provide variation in color intensity upon development of the image.

Figure 1:
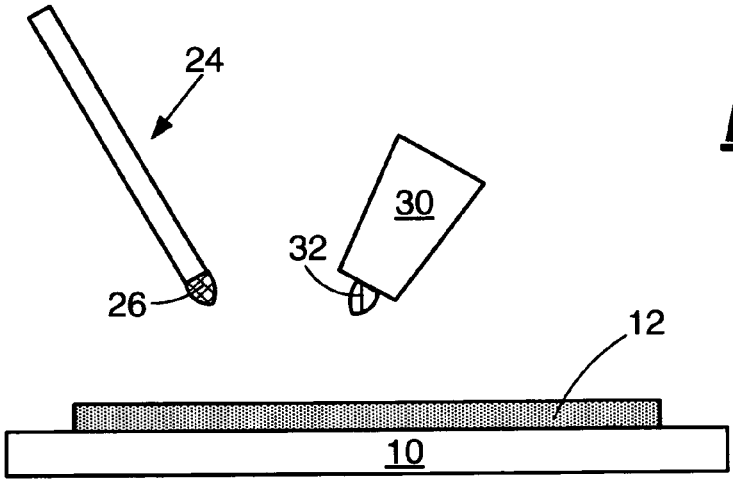
FIG. 1 is an elevational view, not to scale, of a latent image printed substrate, image developer device, and image blocker device according to a first embodiment of the disclosure.
Figure 2:
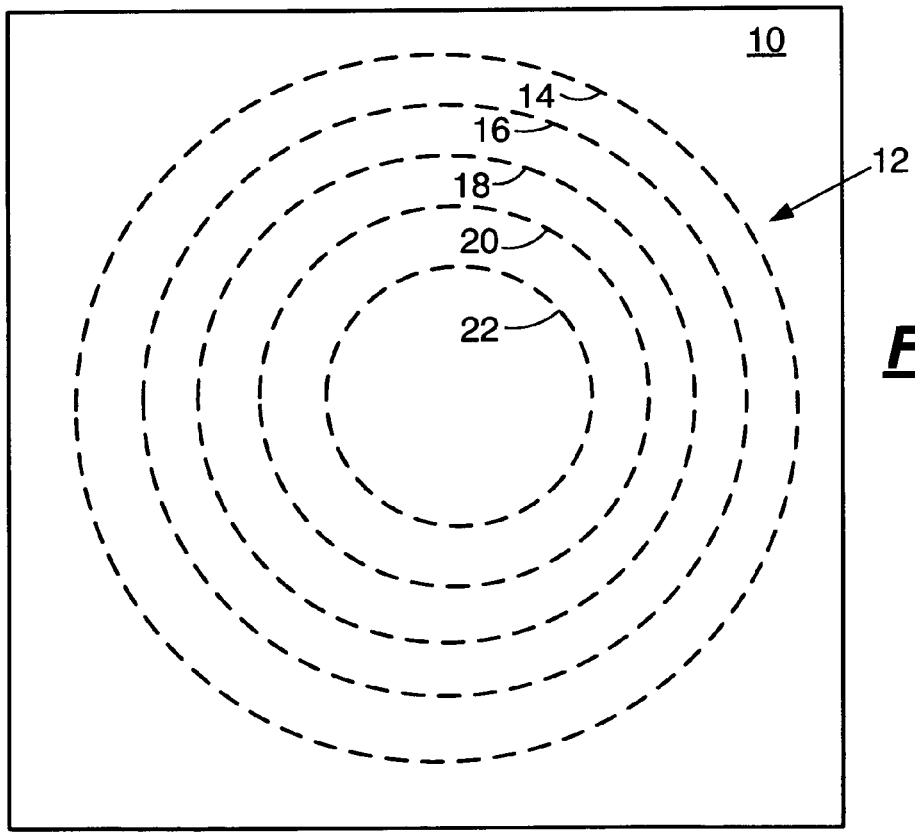
FIG. 2 is a plan view of a latent image printed on a substrate according to the first embodiment of the disclosure.

A suitable flexographic ink composition for providing the latent image 12 may include a solvent-based ink base suitable for use in a flexographic printing process. Ink compositions, as described herein, are substantially colorless and adaptable to four color processing operations. The substrate 10 containing the latent image 12, before development is shown in FIG. 2 wherein the broken line concentric circles 14, 16, 18, 20, and 22, represent different latent image colors.

With respect to the embodiment illustrated in FIGS. 1-8, the ink composition used for applying the latent image 12 to the substrate 10 may include a solvent based ink base containing one or more substantially colorless chromogenic compounds selected from colorless dyes and colorless pigments. For the purpose of simplicity, the chromogenic compound may be referred to as a colorless dye, however, the term colorless dye, when used also includes other colorless chromogenic compounds such as colorless pigments and the like.

Accordingly, the ink base may include a colorless dye, a polyamide resin, and one or more of ethanol, heptane, n-propyl acetate, isopropyl alcohol, n-propanol, and nitrocellulose. Such ink compositions may contain from about 1 to about 10 percent by weight colorless dye, from about 10 to about 45 percent by weight polyamide resin, from about 10 to about 45 percent by weight ethanol, from about 5 to about 15 percent by weight heptane, and from about 0.5 to about 10 percent by weight of one or more of the other components.

The colorless dye may be dissolved in a solvent portion of the ink base using conventional high shear mixing with heating. After the colorless dye is dissolved in the solvent portion of the ink base, the dissolved dye and a varnish portion of the ink base are then mixed at relatively low speeds with other components of the ink base. Suitable colorless dyes may be available from Intense Printing, Inc., of Dallas, Tex. under the trade names IPI 2537 YL (yellow), IPI 21115 BK (black), IPI 32212 BL (blue), IPI 32219 BLS (higher solubility blue), and IPI 854 RD (red). Exemplary ink formulations containing one or more of the foregoing dyes are contained in the following tables.

TABLE 1

| Colorless Ink Component | Weight Percent Range |
|---|---|
| N-propanol | 0.5-1.5 |
| Isopropyl Alcohol | 1.0-4.0 |
| N-propyl Acetate | 1.0-4.0 |
| Heptane | 7.5-9.5 |
| Ethanol | 35.0-45.0 |
| Polyamide Resin Flexographic Ink Base | 35.0-45.0 |
| Colorless Dye(s) | 4.5-6.5 |

The foregoing ink formulation is generally considered a solvent-base ink formulation. However, the colorless dyes may also be used with a substantially aqueous-base ink formulation. As with the solvent-base formulation given in table 1, the colorless dye for the aqueous-base formulation may be dissolved in a solvent portion of the ink base containing a minor amount of the copolymer using conventional high shear mixing with heating. After the colorless dye is dissolved in the solvent portion of the ink base, the dissolved dye and the remaining copolymer portion of the ink base are then mixed at relatively low speeds. A suitable aqueous-base ink formulation is contained in the following table 2.

TABLE 2

| Colorless Ink Component | Weight Percent Range |
|---|---|
| Styrene/acrylic copolymer suspended in water | 30.0-80.0 |
| Isopropyl Alcohol | 2.0-10.0 |
| Dipropylene glycol monomethyl ether | 1.0-3.0 |
| 2,4,7.9-tetramethyl-5-decyne-4,7-diol | 1.0-3.0 |
| Colorless Dye(s) | 4.5-6.5 |

While the foregoing compositions are particularly suitable for the first embodiment of the disclosure, other colorless ink formulations may be used with suitable developers and blocker compounds to provide the benefits and advantages described herein. Additional, two or more of the dyes may be combined to provide higher intensity color development. For example, a relatively low solubility blue dye IPI 32212 BL) mixed with a relatively high solubility blue dye (IPI 32219 BLS) may provide a greater color intensity than either one of the dyes alone at a same dye concentration as the concentration of the mixed dyes.

Additional components may be present in the ink formulations including, but not limited to, film formers, fillers, binders, waxes, non-volatile diluents, uv absorbers, antioxidants and starch particles (stilt). Film formers, which may be used include polyvinyl pyrrolidone, polyvinyl alcohol, starch, grafted starch and the like. In addition, the film former provides excellent rheological properties to the ink formulation that may permit the image to be spot coated or printed using conventional flexographic printing equipment. The film former may also aid in maintaining the chromogenic compound at the surface of the substrate 10 so that solvent interaction with a developer composition produces a sharp image on the surface of the substrate 10.

The binders with may be used to prepare the ink formulations for printing on the substrate 10 may be selected from partially or fully hydrolyzed polyvinyl alcohols, natural or modified starches, acrylics and the like. A preferred binder is a modified starch available under the trade name PENSIZE 730 binder available from Penford Products of Cedar Rapids, Iowa.

Fillers which may be included in the ink formulations may be selected from any number of compounds such as calcium carbonate, wheat starch, rice starch, nitrous cellulose, and/or polyamide resin.

Diluents may also be used to reduce the viscosity of the ink formulation for printing and to reduce curling of the coated substrate. Suitable diluents include, but are not limited to, ethyl alcohol, isopropyl alcohol, and methyl glucocide.

The amount of ink formulation deposited or printed on the substrate 10 may vary with the characteristics of the substrate 10 and the use thereof. Higher coating weights may be used for more porous substrates 10, whereas lower coating weights may be acceptable for substantially non-porous substrates 10. For many substrates, it is desirable to apply a sub-layer between the substrate 10 and the latent image 12 in order to reduce the absorbence of ink into the substrate 10 or reduce the contrast between the latent image 12 and the non-printed portions of the substrate 10 adjacent the printed areas. Such sublayer may comprise a pigmented coating of ink such as an amine solubilized acrylic, overprint varnish or other material which substantially reduces the contrast between the substrate 10 and the latent image printed 12 printed on the substrate 10. A preferred sublayer is a starch-based coating containing $TiO_2$ or $CaCO_3$ plus an optical brightener. It is particularly desirable to use a sublayer which provides a difference in reflectance between the substrate 10 and the latent image 12 of less than about five percent.

The preferred coating weights of the latent image 12 printed on the substrate 10 may range from about 0.25 to about 2 pounds per 1300 square feet. Accordingly, the thickness of the latent image 12 after drying may range from about 0.25 micron to about 3 micron. The preferred thickness of the latent image 12 is about 0.65 micron.

Before the substrate 10 is printed with the latent image 12, it may be desirable to coat an opposing surface of the substrate 10 with a varnish or stiffening material to reduce substrate 10 curling particularly when the substrate 10 is a thin web such as paper or a plastic film. A particularly suitable varnish is a flexo applied sizing varnish.

The ink formulations provided above in Table 1, may be spot printed on a substrate 10 using a COMPCO COMAMANDER printer with 10-11 billionths of a cubic meter (BCM), 200 line anilox rolls with a doctor blade or a NILPETER printer with 8-9 BCM, 300 anilox rolls. Other printing techniques may also be used to provide the latent image 12 on the substrate 10 according to the disclosed embodiments and the amount of base ink to dye may be adjusted for lower or higher BCM anilox rolls.

In order to develop the latent image 12, a device or instrument 24 containing a developer composition may be used to apply the developer composition to selected portions of the latent image 12. The instrument 24 for applying the developer composition to the latent image 12 may include solvent pen having a felt solvent dispensing tip 26. The production of suitable felt tipped pens for dispensing solvents is well known in the art. Other developer compositions may be applied by use of other devices such as fingers dipped into a finger paint type developer composition, crayon-like developers, developer towelettes, and other developer carrier vessels.

Figure 3:
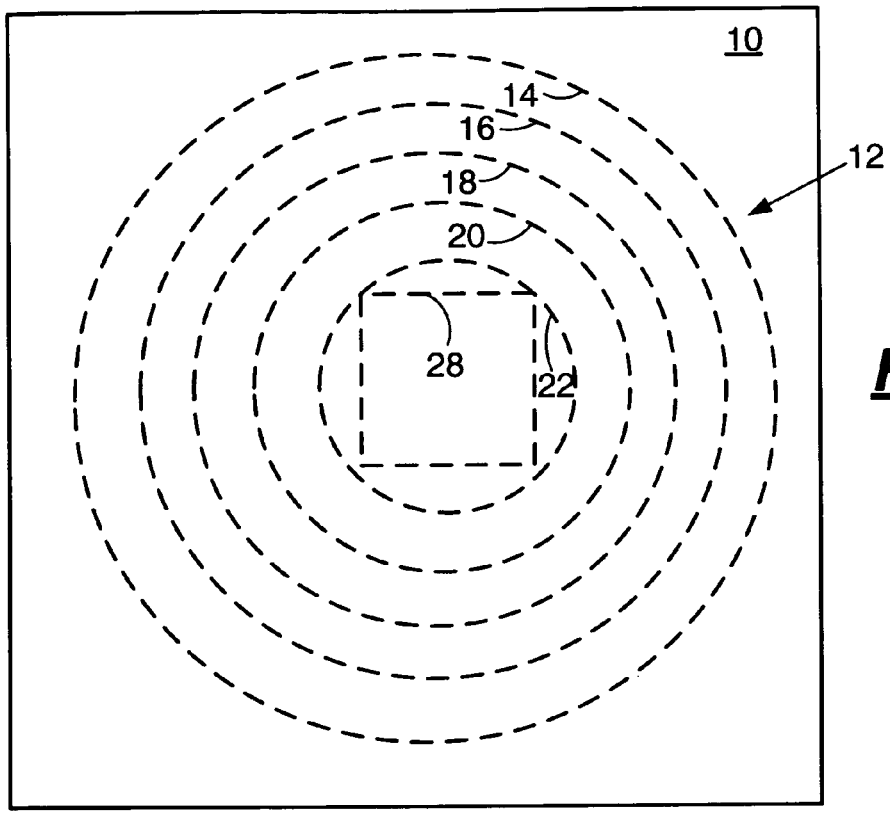
FIG. 3 is a plan view of the latent image of FIG. 3 after a blocker composition has been applied to the latent image in a particular area.

Prior to developing the latent image 12, a secret message may be written on the latent image as indicated by the broken-line rectangle 28 in FIG. 3. The secret message may be written by applying a blocking composition from a blocking marker 30 having a felt dispensing tip 32 to selected portions of the latent image 12. The blocking marker 30 may be used to prevent development of selected portions of the latent image 12.

A suitable blocking composition for blocking development of the latent image 12 in the rectangle 28 may an amine compound dissolved in water. A particularly suitable amine compound is triethanolamine. Accordingly, the blocking formulation may include from about 15 to about 35 weight percent triethanolamine and from about 65 to about 85 weight percent water. Above this range, the blocking composition may be less effective. While not desiring to be bound by theory, it is believed that the blocking composition may absorb less into the substrate above about 35 wt. %. Accordingly, an optimal blocking formulation may include from about 20 to about 25 wt. % triethanolamine and from about 75 to about 80 wt. % water.

Figure 4:
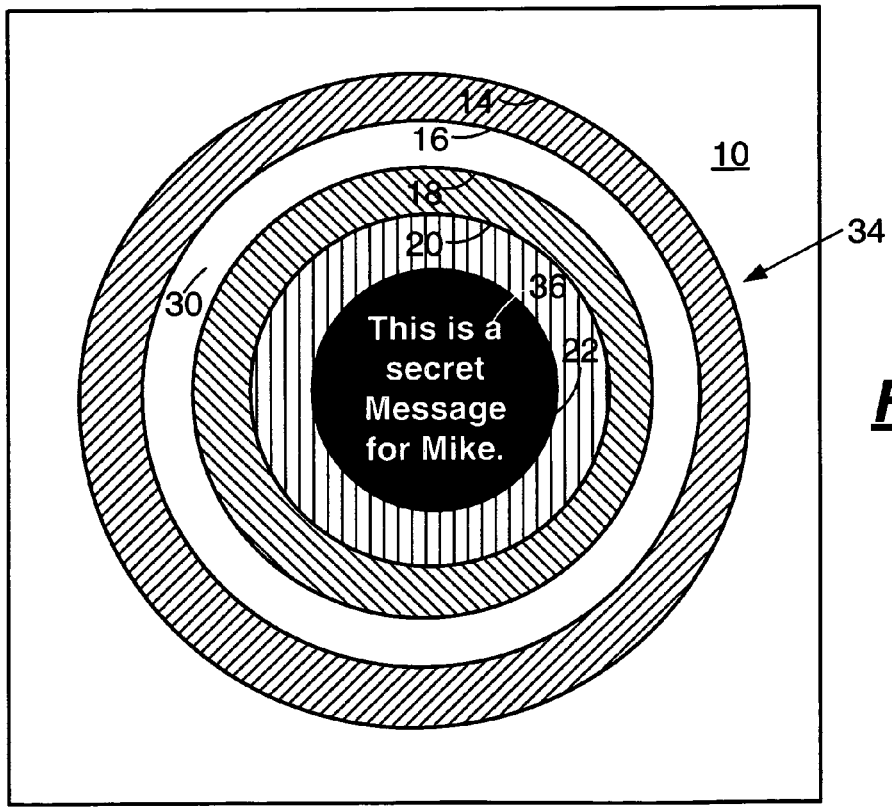
FIG. 4 is a plan view of the developed image of FIG. 3.
Figure 5:
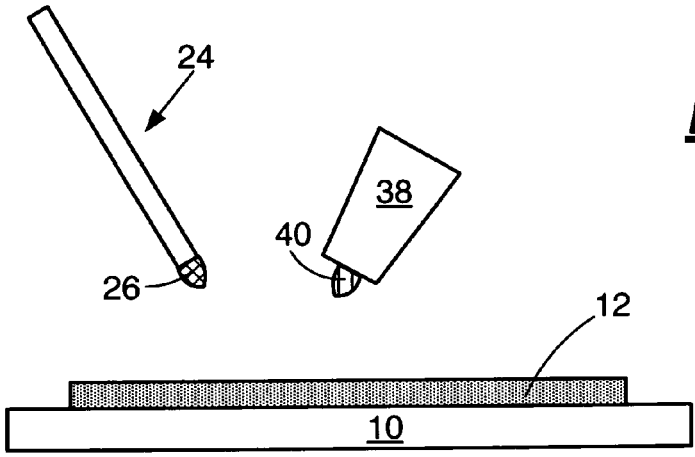
FIG. 5 is an elevational view, not to scale, of a latent image printed substrate, image developer device, and image blocker device according to a second embodiment of the disclosure.
Figure 6:
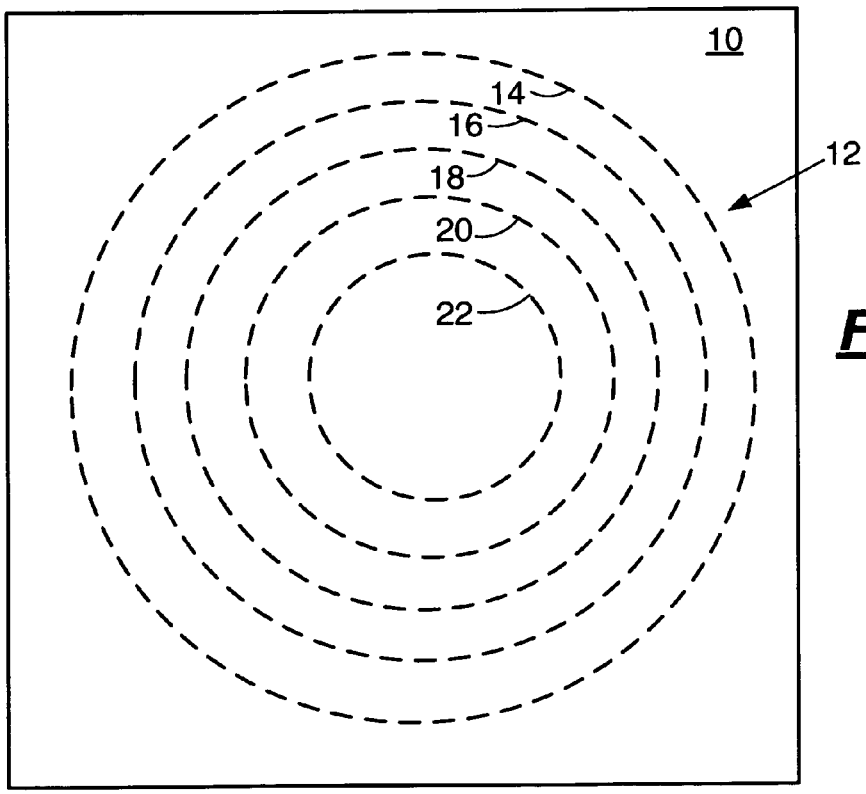
FIG. 6 is a plan view of a latent image printed on a substrate according to the second embodiment of the disclosure.
Figure 7:
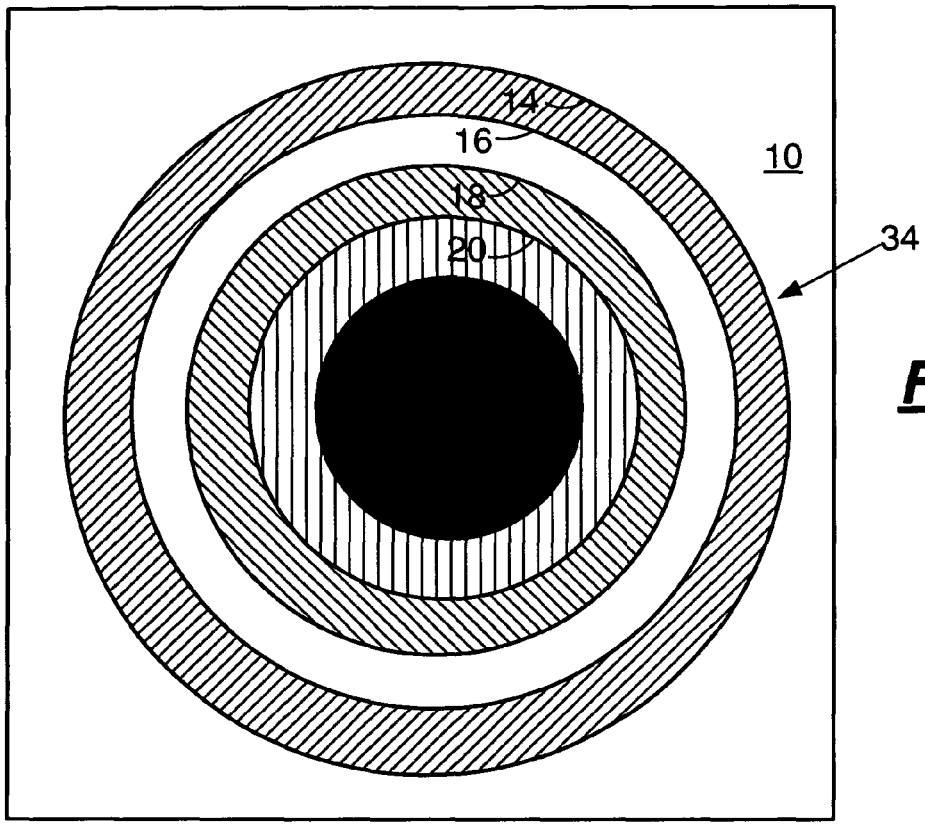
FIG. 7 is a plan view of the latent image of FIG. 6 after a developer composition has been applied to the latent image.

In FIG. 4, the developer composition has been applied to the entire latent image 12 to provide a visible image 34 with the exception of a portion 36 of the image to which the blocking composition was applied. In the alternative, selective portions of the image may be developed by applying the developer composition to only such portions of the image as is desired to be developed. As shown in FIG. 4, each of the concentric circles 14-22 contains a different color upon development. The compositions used to provide the different colors in the concentric circles 14-22 may be applied in a three or four color printing process to provide a wide variety of colors that may be developed as described herein.

In accordance with the foregoing embodiment, a user may encode secret messages by blocking development of selected areas of the latent image 12 using the blocking marker 30. The secret messages 36 may only be revealed by another user having a developer suitable for developing the latent image as shown in FIG. 4 so that the secret message 36 is revealed.

The developer composition for developing the latent image 12 may be selected from acidic clays and unsubstituted or ring-substituted phenols, phenolic resins, sulfone compounds, alkylhydroxybenzoic acid compounds and salicylic acid or salicylate and their metal salts or combinations of two or more of the foregoing. A suitable color developer composition for developing latent images 12 may be a benzoic acid compound dissolved in an alcohol carrier fluid. For example, the developer composition may include from about 5 to about 15 weight percent salicylic acid, from about 65 to about 85 percent by weight isopropyl alcohol and from about 10 to about 20 percent by weight bisphenolic compounds.

Another developer composition that may be used includes from about 30 to about 65 percent by weight metal chloride, from about 10 to about 25 weight percent water, from about 10 to about 25 weight percent propylene glycol, and from about 10 to about 25 weight percent isopropyl alcohol. While zinc chloride is a particularly desirable metal chloride, other metal cations may also be used, such as cadmium (III), zirconium (II), cobalt (II), strontium (II), aluminum (III), copper (III), and tin (II).

Figure 8:
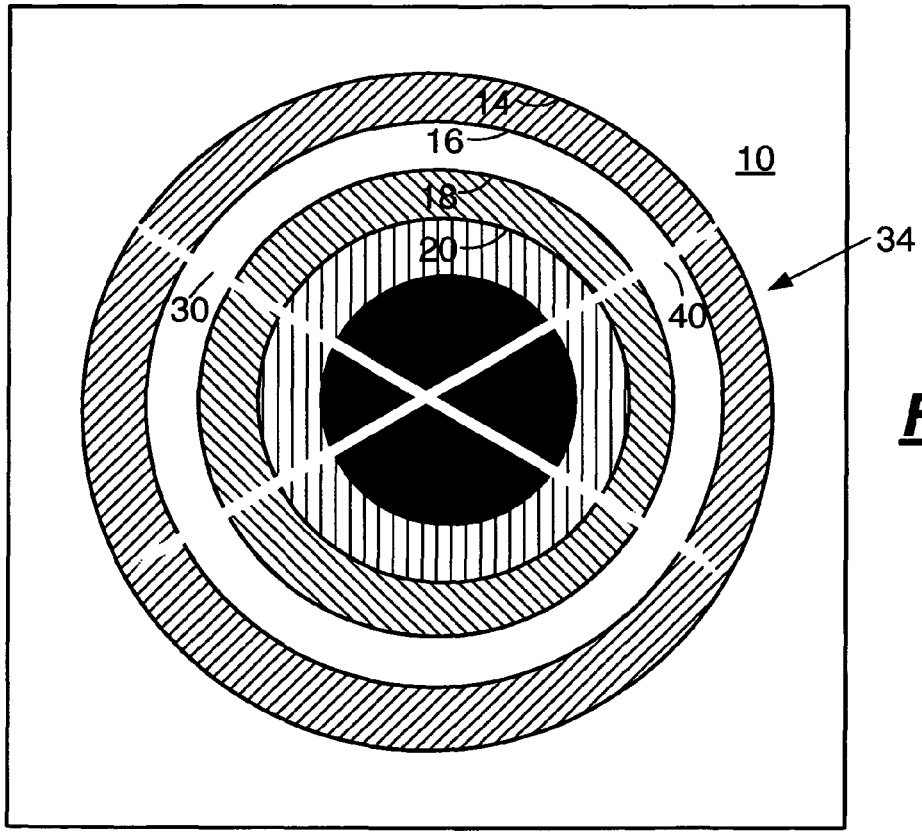
FIG. 8 is a plan view of the developed image of FIG. 7 after an eraser composition has been applied to the developed image of FIG. 7.
Figure 9:
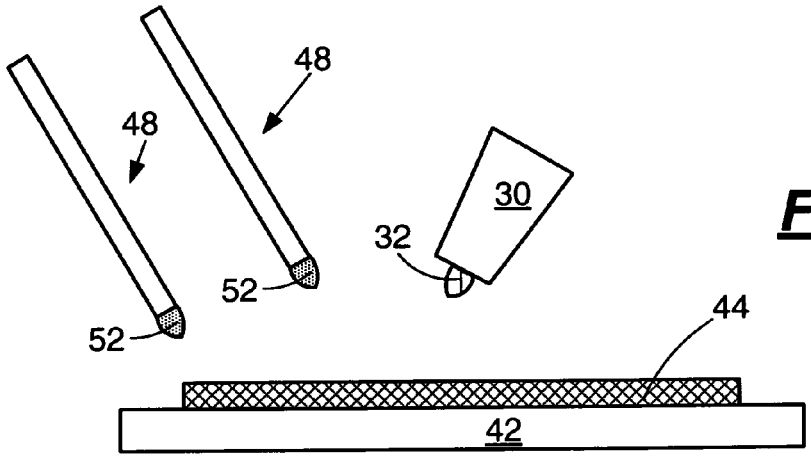
FIG. 9 is an elevational view, not to scale, of a developer printed substrate, coloring device, and image blocking device according to a second embodiment of the disclosure.
Figure 10:
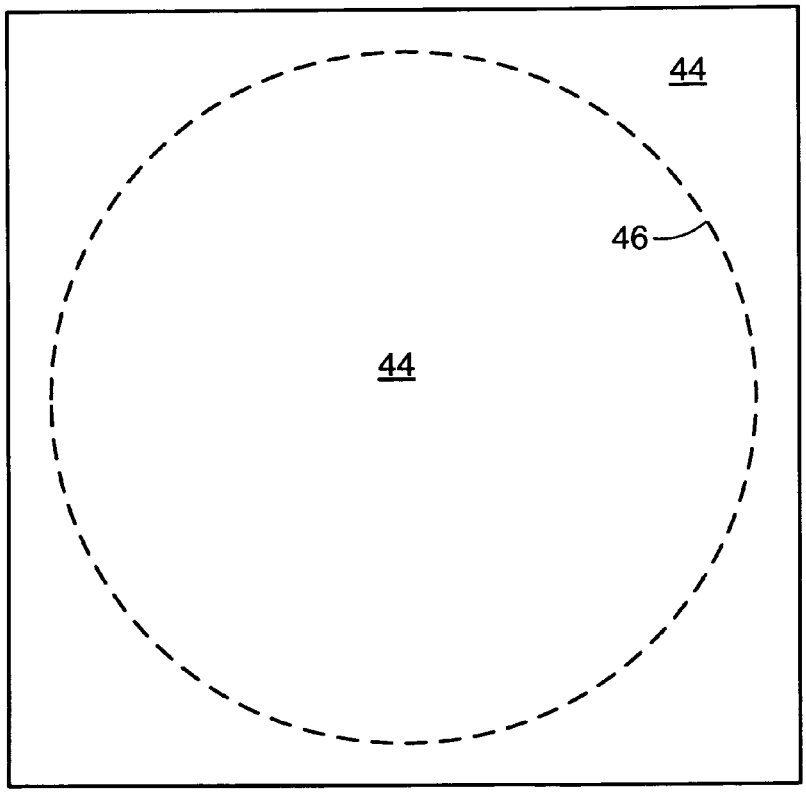
FIG. 10 is a plan view of a substrate having a developer compound printed thereon according to the second embodiment of the disclosure.
Figure 11:
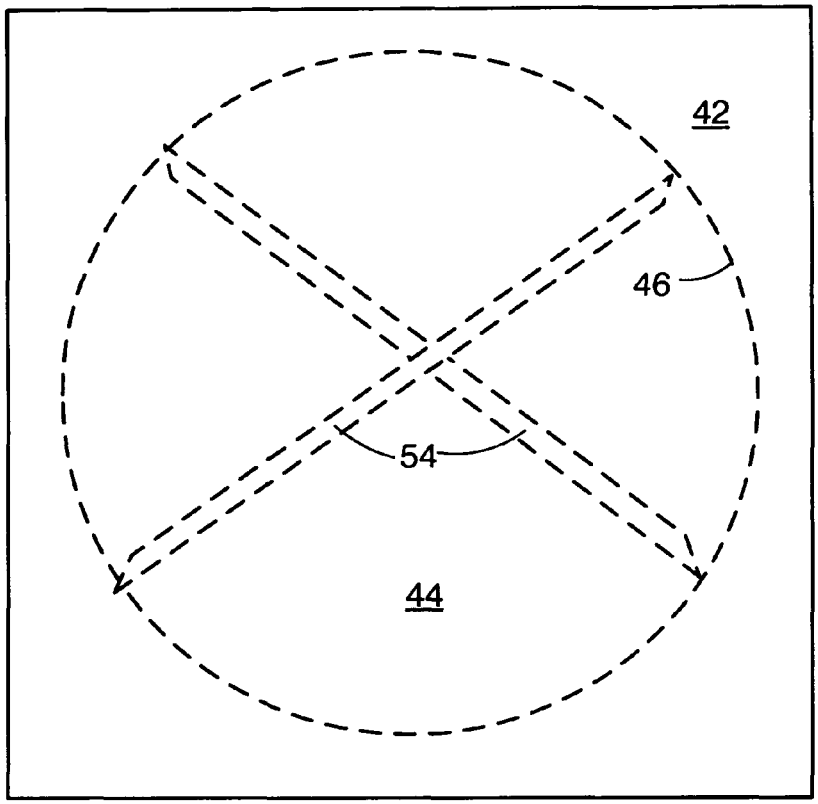
FIG. 11 is a plan view of the substrate of FIG. 10 after a blocking device has been used for preventing development of an image on a portion of the substrate containing developer compound in FIG. 10.

In another embodiment of the disclosure, an eraser instrument 38 (FIG. 5) containing an eraser composition may be used with the printed image 12 to erase or conceal selected portions of the image 12. The eraser instrument 38 may be used as, as illustrated in FIG. 8, to "erase" or otherwise reverse or conceal selected portions 40 of the developed image 34 so that the portions 40 of the image 34 again become substantially colorless in the selected portions 40 as shown in FIG. 8. Accordingly, the eraser instrument 38 may be used to further create unique designs or coloration of images on the substrate 10 or provide concealed messages. As with the blocker composition, the eraser composition may be applied to the latent image 12 or developed image 34 using the eraser instrument 38 having a felt solvent dispensing tip 40. The latent image 12 may be applied to the substrate 10 as described above with reference to FIGS. 1-4.

Like the blocker composition, the eraser composition includes an amine compound dissolved in water. A particularly suitable amine compound is triethanolamine. Accordingly, an eraser formulation may include from about 15 to about 35 weight percent triethanolamine and from about 65 to about 85 weight percent water. Above this range, the eraser composition may be less effective. An optimal eraser formulation may include from about 20 to about 25 wt. % triethanolamine and from about 75 to about 80 wt. % water.

A third embodiment of the disclosure is illustrated in FIGS. 9-12. In this embodiment, a substrate 42 has a developer layer 44 containing a developer compound printed thereon. The substrate 42 containing the printed developer layer 44 is illustrated in plan view in FIG. 10, wherein the developer layer 44 is indicated by the broken line 46.

A printing technique for applying the developer layer 44 to the substrate 42 may include any of the well known printing and substrate coating techniques. Application of the developer composition may be over the entire substrate 42 or may be in selected areas of the substrate 42. Ink jet printing, screen printing, rotogravure printing, flexographic printing, and the like may be used to apply the developer layer 44 to selected portions of the substrate 42. Roll coating, blade coating, dipping, spray coating, and the like may be used to coat an entire portion of the substrate 42. The amount of developer composition applied to the substrate 42 to provide the developer layer 44 may range from about 0.35 micron to about 4.5 microns or more. The developer composition may be applied evenly over the entire substrate 42 or different amounts of developer composition may be applied to different portions of the substrate to provide variations in the intensity of the images and the speed at which the images become visible to provide different image effects.

An advantage of the developer composition in combination with colorless chromogenic compositions is that lighter weight color developer laydown may be used to provide fine detail images and images having vibrant colors, whereas conventional compositions require heavy weight laydown amounts of developer to provide image intensities that only approach the image intensities of the disclosed embodiments. Accordingly, a flexographic process using a 200-400 line anilox roll may apply sufficient developer composition to provide high resolution images upon application of a colorless chromogenic composition to the developer layer 44.

Developer compounds that may be used in the developer composition include, but are not limited to, acidic clays and unsubstituted or ring-substituted phenols, phenolic resins, sulfone compounds, alkylhydroxybenzoic acid compounds and salicylic acid or salicylate and their metal salts or combinations of two or more of the foregoing. Accordingly, a preferred color developer compound may be a benzoic acid, 2-hydroxy-3,5-bis(1-phenylethyl)-, zinc salt and (9,10-dihydro-9-oxa-10-phosphophenanthrene-10-oxide) copolymer with a-methylstyrene, styrene, and polyvinylalcohol. Of the foregoing, compounds, a zinc salicylate resin may be particularly suitable as a component of the developer composition. While zinc is the preferred cation, other metal cations may also be used, such as cadmium (III), zirconium (II), cobalt (II), strontium (II), aluminum (III), copper (III), and tin (II).

A formulation that may be used to print or apply the developer composition onto the substrate 42 may include binders, pigments, surfactacts, water and the like. A particularly useful formulation is provided in the following table.

TABLE 3

| Developer Composition | Weight Percent Range |
|---|---|
| PENSIZE Starch binder | 10-20 |
| SATINTONE 5 HB pigment | 10-20 |
| Zinc salicylate resin | 45-65 |
| Glycol | 1.0-3.0 |
| Defoamer | 1.0-2.0 |
| Water | 5-15 |

Another color developer formulation that may be used is a substantially aqueous color developer composition. The substantially aqueous color developer composition includes from about 30 to about 65 wt. % zinc chloride, from about 10 to about 25 wt. % water, from about 10 to about 25 wt. % propylene glycol, and from about 10 to about 25 wt. % isopropyl alcohol.

Figure 12:
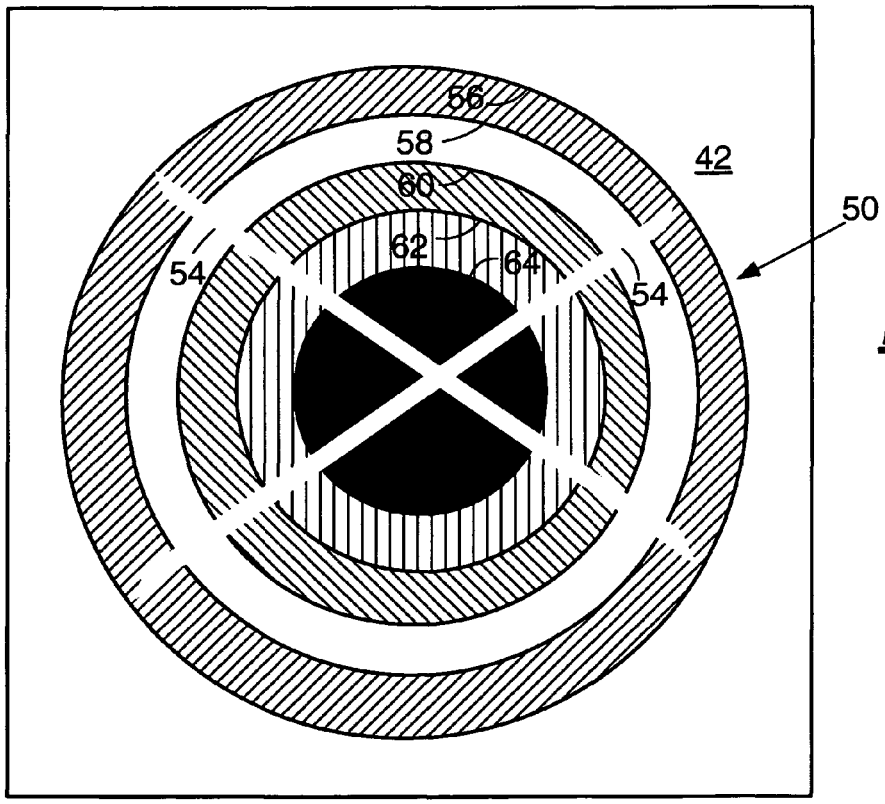
FIG. 12 is a plan view of the substrate of FIG. 11 after coloring devices have applied one or more chromogenic compounds to the substrate containing the developer.

In order to provide an image on the substrate 42, a marking instrument 48, or plurality of marking instruments 48 containing different substantially colorless chromogenic compounds may be used to apply the chromogenic compounds to the developer layer 44 to produce a visible image 50 as shown in FIG. 12. The marking instrument 48 may contain a mixture of the chromogenic compound dissolved in an organic solvent for application to the developer layer 44 through a felt tip 52 portion of the instrument 48.

A formulation containing the colorless chromogenic compound for use in the marking instruments 48 may include from about 75 to about 95 percent by weight alcohol, from about 2 to about 15 percent by weight of the chromogenic compound, and from about 1 to about 10 percent by weight glycol ether. Alcohol solvents which may be used, include, but are not limited to, $C_1$, to $C_4$ alkyl alcohols such as is ethanol, methanol or isopropanol, n-propyl alcohol and the like. Other solvent that may be used include, but are not limited to, $C_1$, to $C_4$ alkyl ethers, $C_1$ to $C_4$ alkyl esters, ketones and acetates. Ketones may include methyl ethyl ketone and acetone. The embodiments described herein also contemplate colorless chromogenic compounds that may be applied with fingers instead of the marking instruments 48.

Prior to applying one or more chromogenic compounds to the developer layer 44, a blocking composition may be applied to the developer layer 44 to prevent development of color upon application of the chromogenic compound to the developer layer 44. Accordingly, the blocking instrument 30 containing the blocking composition described above may be used to provide blocked areas 54, illustrated in outline in FIG. 11 on the developer layer 44. Upon application of the chromogenic compounds to the developer layer 44, the blocked areas 54 remain uncolored as illustrated in FIG. 12 while the remaining portions of the developer layer 44 provide colored images represented by concentric circles 56-64.

Having described various aspects and exemplary embodiments and several advantages thereof, it will be recognized by those of ordinary skills that the disclosed embodiments are susceptible to various modifications, substitutions and revisions within the spirit and scope of the appended claims.

What is claimed is:

1. A latent image developing system, comprising:

a substrate containing a colorless image deposited thereon as an outermost layer on the substrate;

a developer instrument containing a developer composition reactive with the colorless image to provide a visible image; and an image blocking instrument for concealing at least a portion of the visible image on the substrate, the image blocking instrument comprising a blocking composition applicator and an aqueous mixture of blocking composition and water.

2. The latent image developing system of claim 1, wherein the colorless image comprises a substantially colorless chromogenic composition.

3. The latent image developing system of claim 2, wherein the chromogenic composition comprises one or more chromogenic compounds selected from the group consisting of colorless dyes, colorless pigments, and combinations thereof.

4. The latent image developing system of claim 1, wherein the colorless image comprises an image deposited on the substrate from a composition comprising a flexographic ink base and a substantially colorless chromogenic composition.

5. The latent image developing system of claim 1, wherein the developer composition comprises a compound selected from the group consisting of phenolic resins, sulfone compounds, alkylhydroxybenzoic acid compounds, salicylic acid, salicylic acid metal salts, and unsubstituted phenols, and ring-substituted phenols.

6. The latent image developing system of claim 1, wherein the developer composition comprises a zinc salicylate resin in a carrier fluid.

7. The latent image developing system of claim 1, wherein the blocking composition comprises a trialkanolamine.

8. The latent image developing system of claim 1, wherein the blocking composition comprises from about 15 to about 35 weight percent triethanolamine and from about 65 to about 85 weight percent water.

9. A system for printing and developing a colorless image on a substrate, the system comprising:

a substantially colorless flexographic ink base comprising a binder resin and from about 5 to about 20 percent by weight of a substantially colorless compound dissolved in a solvent portion of the ink base for printing the colorless image on the substrate; and a developer instrument comprising a developer compound selected from the group consisting of zinc chloride, and benzoic acid resin, said developer compound being dissolved in from about 30 to about 85 percent by weight carrier fluid.

10. The system of claim 9, wherein the developer instrument comprises a benzoic acid resin dissolved in from about 65 to about 85 weight percent isopropyl alcohol as the carrier fluid.

11. The system of claim 9, wherein the developer instrument comprises from about 30 to about 65 weight percent zinc chloride dissolved in a carrier fluid comprising from about 10 to about 25 weight percent water, from about 10 to about 25 weight percent propylene glycol, and from about 10 to about 25 weight percent isopropyl alcohol.

12. The system of claim 9, wherein the substantially colorless compound comprises a compound selected from the group consisting of colorless dyes, colorless pigments, and combinations thereof.

13. The system of claim 9, wherein the developer compound comprises a benzoic acid resin.

14. The system of claim 9, further comprising an erasing marker comprising from about 15 to about 35% by weight triethanolamine and from about 65 to about 85% by weight water.

* * * * *